US009167668B1

(12) United States Patent
Fitzmaurice

(10) Patent No.: US 9,167,668 B1
(45) Date of Patent: Oct. 20, 2015

(54) SYSTEMS AND METHODS FOR COMMISSIONING LIGHTING FIXTURES

(71) Applicant: The Southern Company, Atlanta, GA (US)

(72) Inventor: Kevin Fitzmaurice, Savannah, GA (US)

(73) Assignee: THE SOUTHERN COMPANY, Atlanta, GA (US)

( * ) Notice: Subject to any disclaimer, the term of this patent is extended or adjusted under 35 U.S.C. 154(b) by 0 days.

(21) Appl. No.: 14/557,583

(22) Filed: Dec. 2, 2014

Related U.S. Application Data

(60) Provisional application No. 62/044,520, filed on Sep. 2, 2014.

(51) Int. Cl.

| | |
|---|---|
| ***H05B 37/02*** | (2006.01) |
| ***H05B 39/04*** | (2006.01) |
| ***H05B 41/36*** | (2006.01) |

(52) U.S. Cl.
CPC ..... *H05B 37/0245* (2013.01)

(58) Field of Classification Search
None
See application file for complete search history.

(56) References Cited

U.S. PATENT DOCUMENTS

| | | | | |
|---|---|---|---|---|
| 2009/0235573 | A1* | 9/2009 | Zhang et al. | 44/302 |
| 2012/0235573 | A1* | 9/2012 | Wu et al. | 315/131 |
| 2014/0070707 | A1* | 3/2014 | Nagazoe | 315/151 |

* cited by examiner

*Primary Examiner* — Anh Tran
(74) *Attorney, Agent, or Firm* — Troutman Sanders LLP; Ryan A. Schneider; Dustin B. Weeks

(57) ABSTRACT

An exemplary embodiment of the present invention a lighting device comprising a processor and a memory comprising instructions that, when executed by the processor, are configured to cause the lighting device to access identification information relating to the lighting device and transmit the identification information to a remotely located system controller automatically upon commissioning the lighting device.

13 Claims, 1 Drawing Sheet

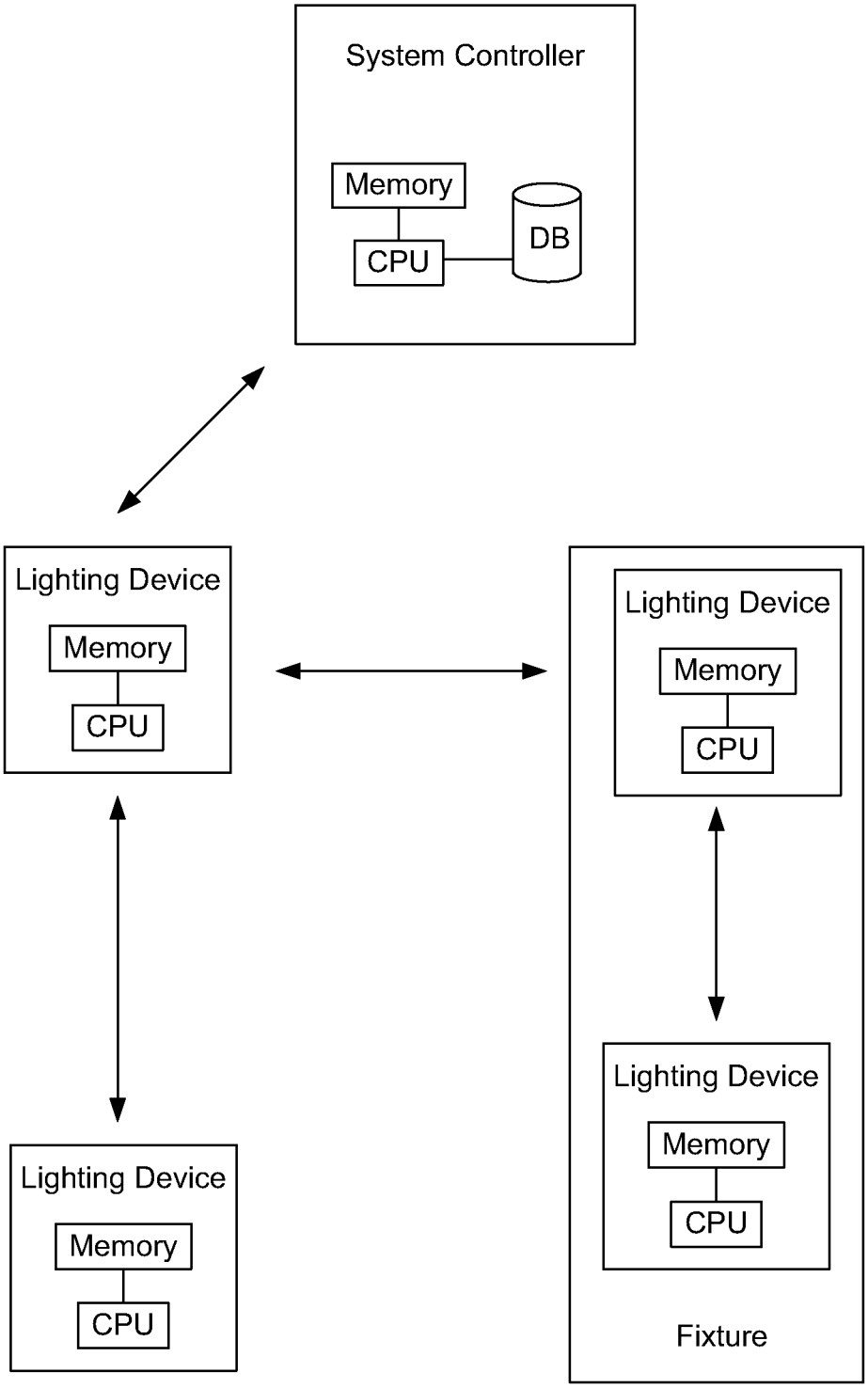
System Controller
Memory
CPU
DB
Lighting Device
Memory
CPU
Lighting Device
Memory
CPU
Lighting Device
Memory
CPU
Lighting Device
Memory
CPU
Fixture

SYSTEMS AND METHODS FOR COMMISSIONING LIGHTING FIXTURES

CROSS-REFERENCE TO RELATED APPLICATION

This application claims benefit under 35 U.S.C. §119(e) of U.S. Provisional Patent Application No. 62/044,520, filed 2 Sep. 2014, entitled "Systems and Methods for Commissioning Lighting Fixtures," which is incorporated herein by reference as if set forth herein in its entirety.

TECHNICAL FIELD OF THE INVENTION

The various embodiments of the present disclosure relate generally to lighting systems. More particularly, the various embodiments of the present invention are directed to systems and methods for commissioning lighting fixtures.

BACKGROUND OF THE INVENTION

In the recent years, there has been a growing interest in remotely controlling individual lighting devices, e.g., lighting ballasts and dimmers, or groups of lighting devices. For example, it may be desirable to transmit control signals to certain devices instructing the devices to turn on, turn off, or dim. These conventional systems often comprise a central controller in communication—either wired or wirelessly—with a plurality of lighting devices. The central controller can receive status information from the devices, e.g., is the light on or off, and can transmit a control signal to the devices to perform one or more actions, e.g., turn the light on or off. One popular protocol employed in conventional lighting control systems is the Digital Addressable Lighting Interface ("DALI") that allows for bi-directional communication between a controller and the lighting devices it is controlling.

When an individual lighting device is being commissioned for use in a lighting control system, the technician installing the device must record certain information about the device, which may include, but is not limited to, the manufacturer, style, part number, manufacture date, wattage, source, correlated color temperature ("CCT"), lumen output, distribution type, and fixture color, dimming method, driver manufacturer, driver part number, customer purchase order number, and/or customer item number. Conventionally, this information must be manually entered into a system level database that can be accessed by the controller. The information entered into the database provides the controller with the information necessary to control the lighting device. Unfortunately, the manual recordation and entering of information about a specific lighting device leads to many errors necessarily associated with manual data collection and entry processes. These errors may lead to the inability of the controller to control certain lighting devices or to improper control signals being sent to certain devices.

Therefore, there is a desire for improved systems and methods for commissioning lighting devices. Various embodiments of the present invention address these desires.

BRIEF SUMMARY OF THE INVENTION

The present invention relates to systems and methods for commissioning lighting devices. An exemplary embodiment of the present invention provides a lighting device comprising a processor and a memory. The memory can comprising instructions that, when executed by the processor, are configured to cause the lighting device to access identification information relating to the lighting device and transmit the identification information to a remotely located system controller automatically upon commissioning the lighting device.

In some embodiments of the present invention, the identification information is transmitted to a remotely located system controller using the Digital Addressable Lighting Interface protocol.

In some embodiments of the present invention, the identification information comprises the manufacturer, style, part number, manufacture date, wattage, source, CCT, lumen output, distribution type, and fixture color.

In some embodiments of the present invention, the identification information further comprises the dimming method, driver manufacturer, driver part number, customer purchase order number, and customer item number of the lighting device.

In some embodiments of the present invention, the instructions, when executed by the processor, are further configured to cause the lighting device to receive a control signal from the system controller and perform a function based on a command in the received control signal.

In some embodiments of the present invention, the instructions, when executed by the processor, are further configured to cause the lighting device to transmit a status message to the network controller indicating a current operating status of the lighting device.

Another exemplary embodiment of the present invention provides an automated lighting system comprising a network controller and a plurality of lighting devices. At least one lighting device in the plurality of lighting device can be configured to automatically transmit identification information associated with the lighting device to the network controller when the lighting device is commissioned.

In some embodiments of the present invention, the network controller can be configured to receive the identification information from the at least one lighting device and store the identification information into a database.

In some embodiments of the present invention, the network controller can be further configured to transmit a control signal to the at least one lighting device.

In some embodiments of the present invention, the control signal comprises a command to be implemented by the at least one lighting device, the command based at least in part on the identification information of the at least one lighting device.

In some embodiments of the present invention, the identification information comprises manufacturer, style, part number, manufacture date, wattage, source, CCT, lumen output, distribution type, and fixture color. In some embodiments of the present invention, the identification information further comprises the dimming method, driver manufacturer, driver part number, customer purchase order number, and customer item number of the lighting device.

Another exemplary embodiment of the present invention provides a method of installing a lighting device. The method can comprise automatically transmitting identification information associated with the lighting device from the lighting device to a network controller when the lighting device is commissioned.

In some embodiments of the present invention, the step of automatically transmitting the identification information occurs without requiring a user to manually collect the identification information.

These and other aspects of the present invention are described in the Detailed Description of the Invention below and the accompanying figures. Other aspects and features of embodiments of the present invention will become apparent to those of ordinary skill in the art upon reviewing the following description of specific, exemplary embodiments of the present invention in concert with the figures. While features of the present invention may be discussed relative to certain embodiments and figures, all embodiments of the present invention can include one or more of the features discussed herein. Further, while one or more embodiments may be discussed as having certain advantageous features, one or more of such features may also be used with the various embodiments of the invention discussed herein. In similar fashion, while exemplary embodiments may be discussed below as device, system, or method embodiments, it is to be understood that such exemplary embodiments can be implemented in various devices, systems, and methods of the present invention.

BRIEF DESCRIPTION OF THE DRAWINGS

The following Detailed Description of the Invention is better understood when read in conjunction with the appended drawings. For the purposes of illustration, there is shown in the drawings exemplary embodiments, but the subject matter is not limited to the specific elements and instrumentalities disclosed.

FIG. 1 illustrates an automated lighting system and lighting device, in accordance with an exemplary embodiment of the present invention.

DETAILED DESCRIPTION OF THE INVENTION

To facilitate an understanding of the principles and features of the present invention, various illustrative embodiments are explained below. The components, steps, and materials described hereinafter as making up various elements of the invention are intended to be illustrative and not restrictive. Many suitable components, steps, and materials that would perform the same or similar functions as the components, steps, and materials described herein are intended to be embraced within the scope of the invention. Such other components, steps, and materials not described herein can include, but are not limited to, similar components or steps that are developed after development of the invention.

As discussed above, conventional lighting systems and devices suffered from the requirement that users installing the lighting devices were required to manually record identification information about the lighting devices and manually enter that information into a data base accessible by the system controller, leading to many errors in the data collection and entry processes. Accordingly, some embodiments of the present invention are directed to lighting devices, systems, and methods wherein a lighting device automatically transmits its identification information to a system controller when the lighting device is commissioned, i.e., when the lighting device is installed and connected to a communication network. Because the device can automatically transmit its information, without requiring a human to manually collect and enter the data, the reliability of the information received by the system controller (or database associated therewith) is drastically increased.

As shown in FIG. 1, an exemplary embodiment of the present invention provides a lighting device comprising a processor and a memory. The memory can comprise instructions that, when executed by the processor, are configured to cause the lighting device to access identification information relating to the lighting device and transmit the identification information to a system controller automatically upon commissioning the lighting device. As used herein, information is transmitted to a system controller when the information is transmitted to the controller or a related device for storing the information and making it accessible by the controller. The memory and processor can be many different memories and processors known in the art. In some embodiments, the system controller is remotely-located from the lighting device. For example, the lighting device may be located in one room of a building while the system controller is located in another room of the building or in another building entirely.

The lighting device can be in communication with the system controller many different ways known in the art, including wired and wireless communication means. In some embodiments, the lighting device and the system controller are in direct communication. In some embodiments, the lighting device and the system controller are in indirect communication via one or more other devices, including, but not limited to, other lighting device, repeater nodes, and the like. Communication between the lighting device and the system controller can use many different standards and protocols known in the art. In an exemplary embodiment of the present invention, communication between the lighting device and the system controller uses the DALI protocol. Various embodiments of the present invention could also use other communication systems and protocols, including, but not limited to radio frequency identification, near field communication, the National Transportation Communications for Intelligent Transportation System Protocol, and the like.

The identification information automatically transmitted by lighting device to the system controller can vary in accordance with various embodiments of the present invention. In accordance with various embodiments of the present invention, the identification information can include, but is not limited to, one or more of the following: manufacturer; style; part number; manufacture date; wattage; source; CCT; lumen output; distribution type; color; dimming method; driver manufacturer; driver part number; customer purchase order number; customer item number; and the like. In some embodiments of the present invention, the identification information comprises the manufacturer, style, part number, manufacture date, wattage, source, CCT, lumen output, distribution type, and fixture color. In some embodiments of the present invention, the identification information further comprises the dimming method, driver manufacturer, driver part number, customer purchase order number, and customer item number of the lighting device.

In some embodiments of the present invention, lighting device can be configured to receive a control signal from the system controller and perform a function based on a command in the received control signal. For example, the system controller can use the identification information provided by the lighting device to determine a command the lighting device can perform. This command can be transmitted by the system controller to the lighting device in a control signal. The command can be many different types of commands. For example, in an exemplary embodiment, the command can be for the lighting device to dim its output, e.g., to a certain percentage or to a certain lumen count.

In some embodiments of the present invention, the instructions, when executed by the processor, are further configured to cause the lighting device to transmit a status message to the network controller indicating a current operating status of the lighting device. The status message can be many different status messages known in the art, including, but not limited to, whether the lighting device is on (i.e., outputting light) or off or the amount of light currently being output by the lighting device. In some embodiments, the lighting device includes a sensor measuring a condition, e.g., amount of light in the area, and the lighting device can transmit this measured condition to the system controller in the form of a status message.

Another exemplary embodiment of the present invention provides an automated lighting system comprising a network controller and a plurality of lighting devices. The plurality of lighting devices can be geographically dispersed over an area. For example, the lighting devices may be dispersed throughout a building or series of buildings. The lighting devices can be in communication, such as wired or wireless, with the system controller. As discussed above, the system controller can receive status messages from one or more of the plurality of lighting devices and transmit a control signal comprising a command to one or more of the lighting devices. At least one lighting device in the plurality of lighting device can be configured to automatically transmit identification information associated with the lighting device to the network controller when the lighting device is commissioned. In other words, when the lighting device is installed and connected to the communication network allowing communication between the lighting devices and the system controller, the at least one lighting device can automatically transmit identification information relating to the at least one lighting device to the system controller without the need for the human user that installed the device to manually collect the identification information and enter that into a data base (or other storage means) accessible by the system controller.

As described herein, transmitting the identification information to the system controller can include, but is not limited to, transmitting the information to the system controller or transmitting the information to another device that directly or indirectly makes the information accessible to the system controller. In other words, the system controller gains access to the identification information without the installer or another human user being required to manually collect the information and enter it into a device (or storage means) such that it is accessible by the system controller.

In addition to the systems and methods disclosed herein, the present invention also provide methods of installing a lighting device. The method can comprise automatically transmitting identification information associated with the lighting device from the lighting device to a network controller when the lighting device is commissioned. For example, when the lighting device is installed and connected to a communication network to which the system controller is also connected, the lighting device can transmit identification information associated with the lighting device to the system controller (or another device providing the system controller with access to the information as discussed above) without requiring a user to manually collect the identification information. Accordingly, the reliability of the information received by the system controller is greatly increased as the probability of human error during data collection and/or entry is removed or at least decreased from the process.

It is to be understood that the embodiments and claims disclosed herein are not limited in their application to the details of construction and arrangement of the components set forth in the description and illustrated in the drawings. Rather, the description and the drawings provide examples of the embodiments envisioned. The embodiments and claims disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the claims be regarded as including such equivalent constructions.

Furthermore, the purpose of the foregoing Abstract is to enable the United States Patent and Trademark Office and the public generally, and especially including the practitioners in the art who are not familiar with patent and legal terms or phraseology, to determine quickly from a cursory inspection the nature and essence of the technical disclosure of the application. The Abstract is neither intended to define the claims of the application, nor is it intended to be limiting to the scope of the claims in any way. Instead, it is intended that the invention is defined by the claims appended hereto.

What is claimed is:

1. A lighting device comprising:

a processor; and a memory comprising instructions that, when executed by the processor, are configured to cause the lighting device to:

access identification information relating to the lighting device;

transmit the identification information to a remotely located system controller automatically upon commissioning the lighting device, wherein the identification information comprises manufacturer, style, part number, manufacture date, wattage, source, CCT, lumen output, distribution type, and fixture color.

2. The lighting device of claim 1, wherein the identification information is transmitted to a remotely located system controller using the Digital Addressable Lighting Interface protocol.

3. The lighting device of claim 1, wherein the identification information further comprises the dimming method, driver manufacturer, driver part number, customer purchase order number, and customer item number of the lighting device.

4. The lighting device of claim 1, wherein the instructions, when executed by the processor are further configured to cause the lighting device to:

receive a control signal from the system controller; and perform a function based on a command in the received control signal.

5. The lighting device of claim 1, wherein the instructions, when executed by the processor are further configured to cause the lighting device to transmit a status message to the network controller indicating a current operating status of the lighting device.

6. An automated lighting system comprising:

a network controller; and a plurality of lighting devices, at least one lighting device in the plurality of lighting device configured to automatically transmit identification information associated with the lighting device to the network controller when the lighting device is commissioned, wherein the identification information comprises manufacturer, style, part number, manufacture date, wattage, source, CCT, lumen output, distribution type, and fixture color.

7. The automated lighting system of claim 6, wherein the network controller is configured to receive the identification information from the at least one lighting device and store the identification information into a database.

8. The automated lighting system of claim 6, wherein the network controller is further configured to transmit a control signal to the at least one lighting device.

9. The automated lighting system of claim 8, wherein the control signal comprises a command to be implemented by the at least one lighting device, the command based at least in part on the identification information of the at least one lighting device.

10. The automated lighting system of claim 6, wherein the identification information further comprises the dimming method, driver manufacturer, driver part number, customer purchase order number, and customer item number of the at least one lighting device.

11. A method of installing a lighting device comprising automatically transmitting identification information associated with the lighting device from the lighting device to a network controller when the lighting device is commissioned, wherein the identification information comprises manufacturer, style, part number, manufacture date, wattage, source, CCT, lumen output, distribution type, and fixture color.

12. The method of claim 11, wherein the identification information further comprises the dimming method, driver manufacturer, driver part number, customer purchase order number, and customer item number of the lighting device.

13. The method of claim 11, wherein the step of automatically transmitting the identification information occurs without requiring a user to manually collect the identification information.

* * * * *